US012044107B2

(12) United States Patent
Jeanpert

(10) Patent No.: US 12,044,107 B2
(45) Date of Patent: Jul. 23, 2024

(54) SLIP-ON SWELLABLE PACKER FOR OPENHOLE GRAVEL PACK COMPLETIONS

(71) Applicant: Schlumberger Technology Corporation, Sugar Land, TX (US)

(72) Inventor: Julie Jeanpert, Milan (IT)

(73) Assignee: Schlumberger Technology Corporation

( * ) Notice: Subject to any disclaimer, the term of this patent is extended or adjusted under 35 U.S.C. 154(b) by 105 days.

(21) Appl. No.: 17/907,159

(22) PCT Filed: Mar. 29, 2021

(86) PCT No.: PCT/US2021/024664

§ 371 (c)(1),
(2) Date: Sep. 23, 2022

(87) PCT Pub. No.: WO2021/202388

PCT Pub. Date: Oct. 7, 2021

(65) Prior Publication Data

US 2023/0108380 A1 Apr. 6, 2023

Related U.S. Application Data

(60) Provisional application No. 63/002,277, filed on Mar. 30, 2020.

(51) Int. Cl.

| | |
|---|---|
| ***E21B 43/04*** | (2006.01) |
| ***E21B 33/12*** | (2006.01) |
| ***E21B 43/12*** | (2006.01) |

(52) U.S. Cl.

CPC ..... *E21B 43/04* (2013.01); *E21B 33/1208* (2013.01)

(58) Field of Classification Search

None

See application file for complete search history.

(56) References Cited

U.S. PATENT DOCUMENTS

| | | | |
|---|---|---|---|
| 4,428,431 | A | 1/1984 | Landry et al. |
| 8,371,370 | B2 | 2/2013 | Xu |
| 8,662,159 | B2 | 3/2014 | Xu |
| 8,794,310 | B2 | 8/2014 | Allen et al. |
| 9,359,856 | B2 | 6/2016 | Broussard |

(Continued)

FOREIGN PATENT DOCUMENTS

| | | | |
|---|---|---|---|
| CN | 102803647 | A | 11/2012 |
| WO | 2010083190 | A1 | 7/2010 |

OTHER PUBLICATIONS

International Search Report and Written Opinion issued in the PCT application PCT/US2021/024664, dated Jul. 12, 2021 (10 pages).

*Primary Examiner* — Charles R Nold

(74) *Attorney, Agent, or Firm* — Jeffrey D. Frantz

(57) ABSTRACT

A gravel packing system includes a shoe assembly including a washdown shoe at an end of the shoe assembly and a blank section uphole of the washdown shoe, a base pipe having an upper base pipe joint and a lower base pipe joint coupled at a base pipe joint connection, a screen disposed around the base pipe, wherein the lower base pipe joint is uphole of and adjacent to the blank section of the shoe assembly, and a swellable packer installed around the blank section of the shoe assembly. The shoe assembly, the swellable packer, the base pipe, and the screen are disposed in an uncased section of the wellbore.

12 Claims, 3 Drawing Sheets

(56) References Cited

U.S. PATENT DOCUMENTS

| | | | | |
|---|---|---|---|---|
| 10,060,229 | B2 | 8/2018 | Malbrel et al. | |
| 10,082,000 | B2 * | 9/2018 | Grubert | E21B 43/04 |
| 2010/0163235 | A1 | 7/2010 | Mootoo et al. | |
| 2010/0175894 | A1 * | 7/2010 | Debard | E21B 34/10 166/382 |
| 2010/0300687 | A1 | 12/2010 | Watson et al. | |
| 2011/0146984 | A1 * | 6/2011 | Krush | E21B 43/04 166/278 |
| 2011/0174481 | A1 * | 7/2011 | Gaudette | E21B 43/082 166/227 |

* cited by examiner

SLIP-ON SWELLABLE PACKER FOR OPENHOLE GRAVEL PACK COMPLETIONS

CROSS-REFERENCE TO RELATED APPLICATION

This application is a National Stage of International Application No. PCT/US2021/024664, filed Mar. 29, 2021, which is based on and claims priority to U.S. Provisional Application Ser. No. 63/002,277, filed Mar. 30, 2020, which are incorporated herein by reference in their entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. The problems caused by sand production can significantly increase operational and maintenance expenses and can lead to a total loss of the well.

One way to control sand production is to pack gravel around the exterior of a slotted, perforated, or other type of liner or screen. The gravel serves as a filter to help ensure that formation fines and sand do not migrate with the produced fluids into the wellbore. In a typical gravel pack completion, a screen is placed in the wellbore and positioned within the unconsolidated formation that is to be completed for production. The screen is typically connected to a tool that includes a production packer and a cross-over, and the tool is in turn connected to a work or production tubing string. The gravel is mixed with a carrier fluid and pumped in a slurry down the tubing and through the cross-over, thereby flowing into the annulus between the screen and the wellbore. The carrier fluid in the slurry leaks off into the formation and/or through the screen. The screen is designed to prevent the gravel in the slurry from flowing through it and entering into the production tubing. As a result, the gravel remains in the annulus around the screen where it forms a gravel pack.

In order for the gravel to be tightly packed within the annulus as desired, the carrier fluid must leave the slurry in a process called dehydration. For proper dehydration, there must be paths for the carrier fluid to exit the slurry. Dehydration of the slurry can be difficult to achieve in areas of the annulus that are not adjacent to a fluid path such as a gravel pack screen or perforations into a permeable formation. In areas where there is inadequate dehydration, the carrier fluid restricts the packing of the gravel and can lead to voids within the gravel pack. Sections of wellbore located between gravel pack screens are areas where it is difficult to achieve a gravel pack. The area of the wellbore below the lowest perforated zone is another location that can lead to voids within the gravel packed annulus. Over time, the gravel that is deposited within the annulus may have a tendency to settle and fill any void areas, thereby loosening the gravel pack that is located higher up in the wellbore, and potentially creating new voids in areas adjacent to producing formations.

Once the well is placed into production, the flow of produced fluids will be concentrated through any voids that are present in the gravel pack. This can cause fines and sand from the formation to flow with the produced fluids and can lead to one or more of the problems discussed above. Accordingly, there is a need for improved tools and methods to improve slurry dehydration and to minimize the creation of voids during a gravel pack completion of a wellbore.

SUMMARY

A gravel packing system deployed in a wellbore having cased and uncased sections according to one or more embodiments of the present disclosure includes a shoe assembly including a washdown shoe at an end of the shoe assembly and a blank section uphole of the washdown shoe, a base pipe having an upper base pipe joint and a lower base pipe joint coupled at a base pipe joint connection, a screen disposed around the base pipe, wherein the lower base pipe joint is uphole of and adjacent to the blank section of the shoe assembly, and a swellable packer installed around the blank section of the shoe assembly, wherein the shoe assembly, the swellable packer, the base pipe, and the screen are disposed in the uncased section of the wellbore.

A method according to one or more embodiments of the present disclosure includes installing a swellable packer in a gravel packing system, the gravel packing system including: a shoe assembly including a washdown shoe at an end of the shoe assembly and a blank section above the washdown shoe, a base pipe having an upper base pipe joint and a lower base pipe joint coupled at a base pipe joint connection, and a screen disposed around the base pipe, wherein the lower base pipe joint is above and adjacent to the blank section of the shoe assembly, and wherein the swellable packer is installed around the blank section of the shoe assembly, deploying the gravel packing system in a wellbore such that the shoe assembly, the swellable packer, the base pipe, and the screen are disposed in an uncased section of the wellbore, swelling the swellable packer until the swellable packer contacts a wall of the wellbore in the uncased section, starting a gravel packing operation using the gravel packing system, and starting a production operation after the gravel packing operation is completed.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," "top" and "bottom," "left" and "right," and other like terms indicating relative positions above or below a given point or element are used in this description to more clearly describe some embodiments of the disclosure.

The present disclosure generally relates to tools to complete subterranean wells. More specifically, one or more embodiments of the present disclosure relate to apparatus and methods used in gravel packing operations.

Figure 1:
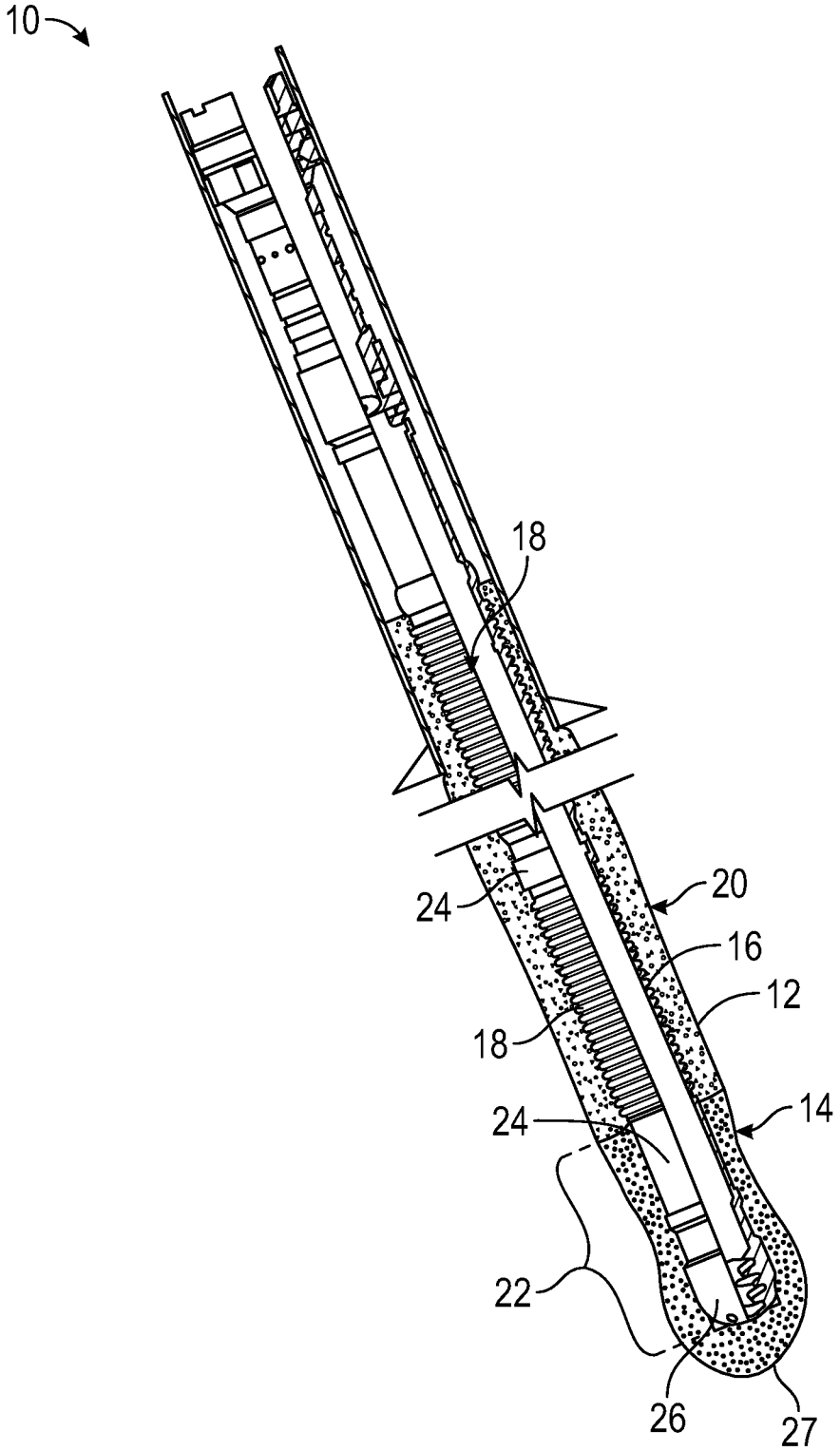
FIG. 1 shows gravel placement in an openhole wellbore at the end of a gravel pack operation.

Referring now to FIG. 1, gravel placement in an openhole wellbore 12 at the end of a gravel pack operation is shown. As previously described, a slurry 14, which includes gravel mixed with a carrier fluid, is pumped downhole through a gravel packing system 10 to fill the annulus 16 between one or more sand control screens 18 and the wellbore 12. The carrier fluid in the slurry 14 leaks off into the formation and/or through the sand control screen 18. The sand control screens 18 are designed to prevent the gravel in the slurry 14 from flowing through the sand control screens 18 and entering into the production tubing. That is, the slurry 14 is dehydrated across the sand control screens 18 in a gravel packing operation. This occurs predominately around the lowest filtration point of the gravel packing system 10. As a result, packed gravel 20 remains in the annulus 16 around the sand control screens 18 forming a gravel pack.

Still referring to FIG. 1, the gravel packing system 10 may include a shoe assembly 22 at an end of the gravel packing system 10 beyond the last sand control screen 18, and the shoe assembly 22 may include a blank section 24 uphole of a washdown shoe 26. Screen joint connections that couple sand control screen joints together may also include a blank section 24. Blank sections 24 are essentially dead zones that are void of screen openings or perforations. As a result, no dehydration may occur across the blank section 24. Consequently, slurry 14 (i.e., unpacked gravel) remains in the annulus 16 at the shoe assembly 22 and at the toe 27 of the wellbore 12.

Figure 2:
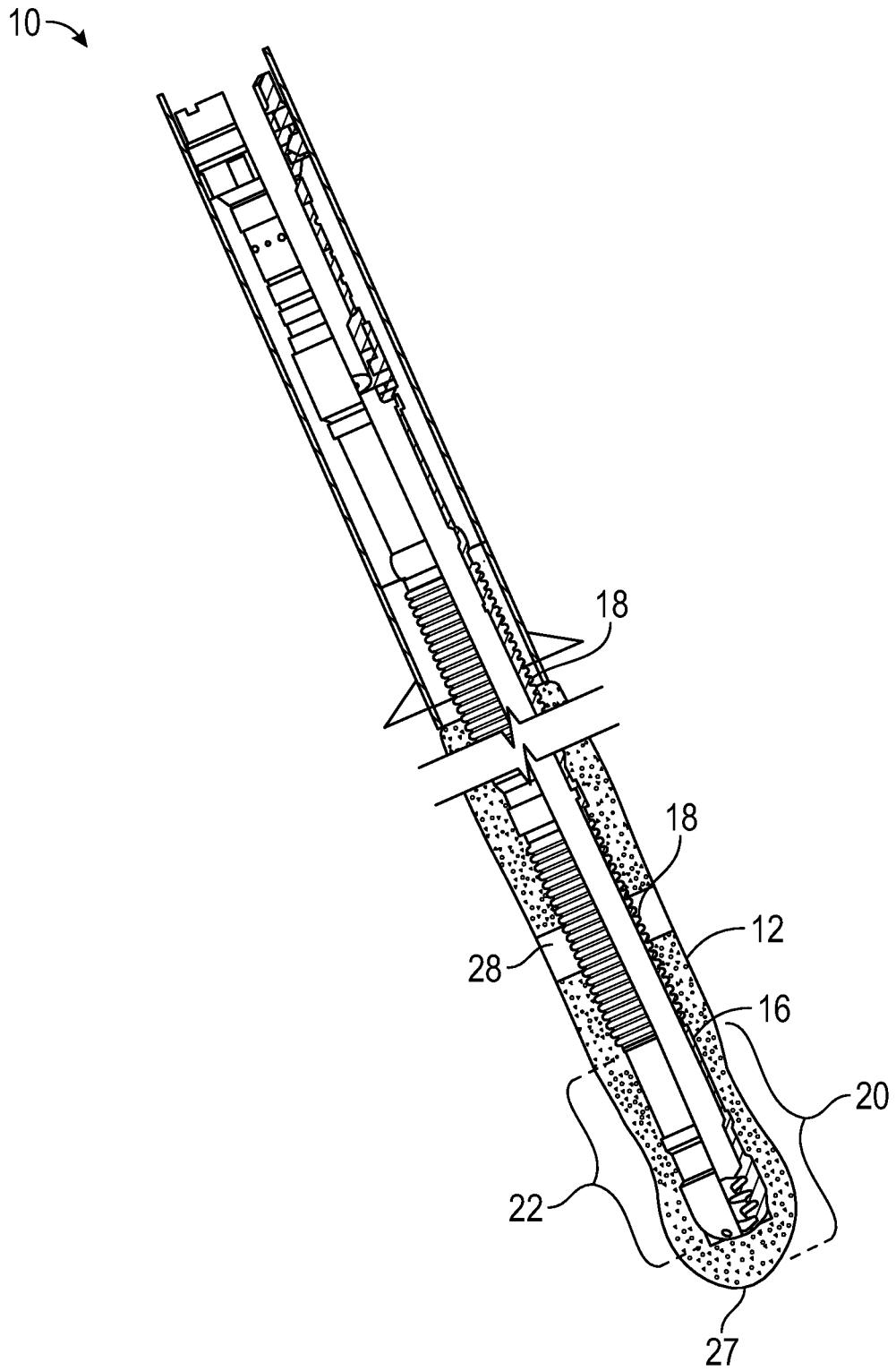
FIG. 2 shows gravel shifting to the toe of the openhole wellbore after a gravel pack operation.

Referring now to FIG. 2, packed gravel 20 shifting to the toe 27 of the openhole wellbore 12 after a gravel pack operation is shown. Specifically, FIG. 2 shows that after the gravel pack placement shown in FIG. 1, some of the packed gravel 20 may shift into the annular space around the shoe assembly 22 and the toe 27. The shifting of the packed gravel 20 may be driven by gravity (in vertical or slanted wells) or by flux when a production operation starts after the gravel pack operation. As shown in FIG. 2, the shifting of the packed gravel 20 creates voids 28 in the packed gravel 20 within the annulus 16, which may uncover portions of the sand control screens 18. Leaving portions of the sand control screens 18 uncovered exposes the sand control screens 18 to undesirable high velocity well fluids during production, leading to erosion of the sand control screens 18, which renders the sand control screens 18 inoperative for their intended purpose.

Figure 3:
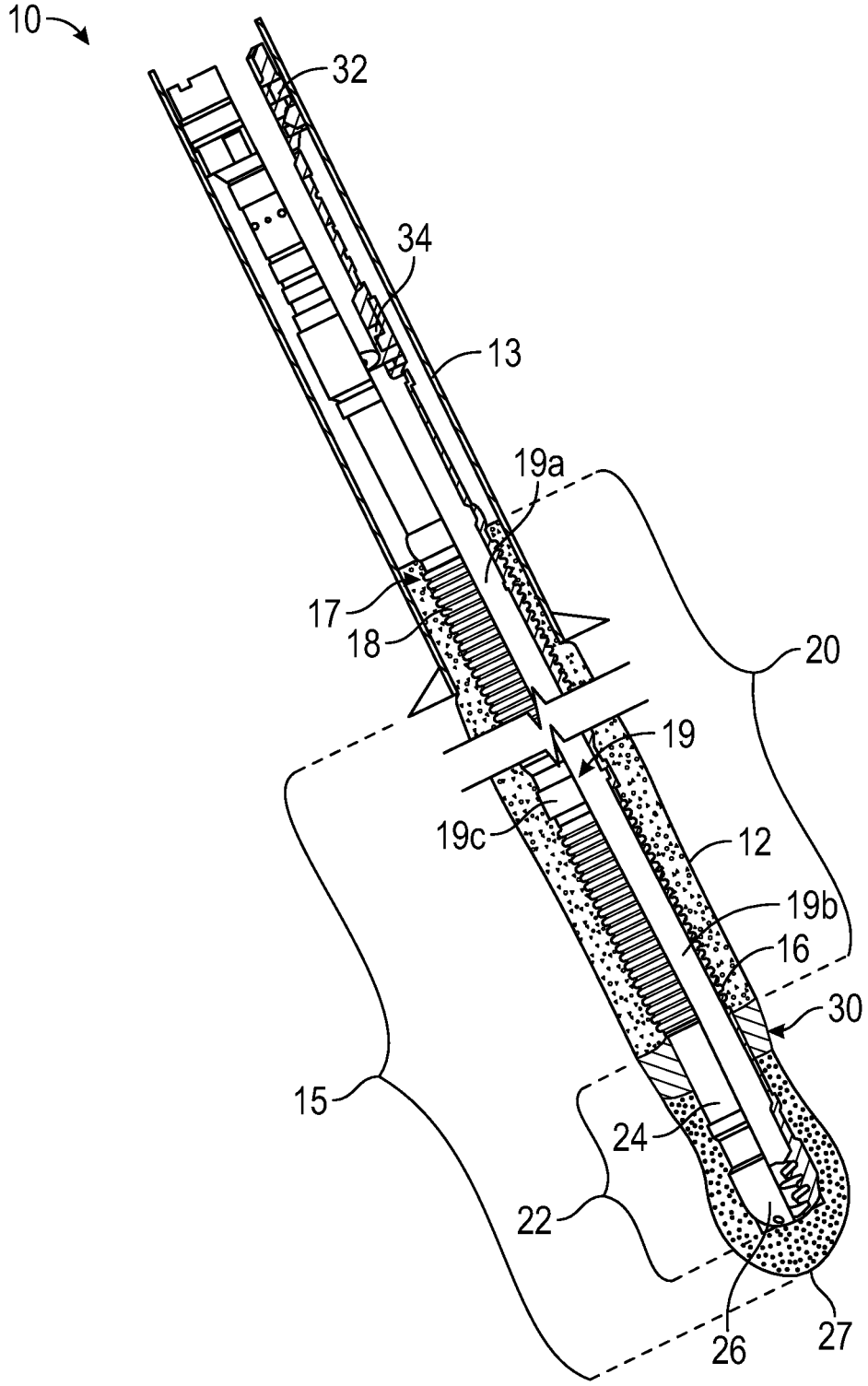
FIG. 3 shows a gravel packing system that includes a swellable packer according to one or more embodiments of the present disclosure.

Referring now to FIG. 3, a gravel packing system 10 according to one or more embodiments of the present disclosure is shown. Specifically, FIG. 3 shows that the gravel packing system 10 according to one or more embodiments of the present disclosure includes a swellable packer 30. As shown in FIG. 3, and as further described below, the advantageous effects of installing the swellable packer 30 according to one or more embodiments of the present invention in the gravel packing system 10 are evident.

Still referring to FIG. 3, the gravel packing system 10 according to one or more embodiments of the present disclosure is disposed in a wellbore 12 having cased and uncased sections. The cased section of the wellbore 12 is defined by a casing 13, and an openhole section 15 of the wellbore 12 is uncased. In one or more embodiments of the present disclosure, the gravel packing system 10 includes a shoe assembly 22 that includes a washdown shoe 26 at an end of the shoe assembly 22 and a blank section 24 uphole of the washdown shoe 26. In one or more embodiments of the present disclosure, the shoe assembly 22, including the washdown shoe 26 and the blank section 24 are disposed in the uncased section of the wellbore 12.

Still referring to FIG. 3, the gravel packing system 10 according to one or more embodiments of the present disclosure also includes one or more sand control assemblies 17 that include a base pipe 19 and a sand control screen 18 disposed around the base pipe 19. In one or more embodiments, the base pipe 19 includes an upper base pipe joint **19*a* and a lower base pipe joint 19*b* coupled at a base pipe joint connection 19*c*. According to one or more embodiments of the present disclosure, the upper base pipe joint 19*a* and the lower base pipe joint 19*b* are perforated, and the base pipe joint connection 19*c* is a blank section without any perforations. As shown in FIG. 3, the lower base pipe joint 19*b* is uphole of and adjacent to the blank section 24 of the shoe assembly 22. According to one or more embodiments of the present disclosure, the blank section 24 of the shoe assembly 22 provides a box end for a pin end of the lower base pipe joint 19*b* to engage. In one or more embodiments of the present disclosure, the one or more sand control assemblies 17, including the base pipe 19 and the sand control screen 18, are at least partially disposed in the uncased section of the wellbore 12**.

Still referring to FIG. 3, the gravel packing system 10 according to one or more embodiments of the present disclosure also includes a swellable packer 30 installed around the blank section 24 of the shoe assembly 22 in the uncased section of the wellbore 12. In one or more embodiments of the present disclosure, the swellable packer 30 is configured to slip onto the blank section 24 of the shoe assembly 22. In one or more embodiments of the present disclosure, the swellable packer 30 can be made of any swellable material. Illustrative swellable materials can be or include styrene butadiene hydrocarbon, ethylene propylene monomer rubber hydrocarbon, natural rubber hydrocarbon, ethylene propylene diene monomer rubber hydrocarbon, ethylene vinyl acetate rubber hydrocarbon, hydrogenized acrylonitrile-butadiene rubber hydrocarbon, acrylonitrile butadiene rubber hydrocarbon, isoprene rubber hydrocarbon, chloroprene rubber hydrocarbon, or polynorbornene hydrocarbon.

As also shown in FIG. 3, the gravel packing system 10 according to one or more embodiments of the present disclosure may also include a gravel pack packer 32 and a formation isolation device 34 to facilitate gravel packing operations. For example, the gravel pack packer 32 may be used to isolate segments of the wellbore 12 during gravel packing operations. In one or more embodiments of the present disclosure, the formation isolation device 34 may be a bidirectional barrier valve that isolates reservoir fluids in the lower completion. The bidirectional barrier of the formation isolation device 34 according to one or more embodiments of the present disclosure facilitates interventionless transition from the lower completion to the upper completion.

Still referring to FIG. 3, because the swellable packer 30 according to one or more embodiments of the present disclosure is installed around the blank section 24 of the shoe assembly 22, upon swelling to contact a wall of the uncased wellbore 12 to form a seal, the swellable packer 30 is able to isolate the sump volume located below the lowermost filtration point (i.e., below the lower base pipe joint 19*b* and corresponding sand control screen 18), which includes the annular volume around the shoe assembly 22 as well as any rathole below the shoe assembly 22 at the toe 27. By isolating the sump volume located below the lowermost filtration joint, packed gravel 20 deposited in the annulus 16 of the wellbore 12 during a gravel packing operation remains in place during the gravel packing operation and subsequently during production, which enhances the life of the well and its performance.

A method according to one or more embodiments of the present disclosure includes installing a swellable packer 30 around the blank section 24 of the shoe assembly 22 of the gravel packing system 10. In one or more embodiments of the present disclosure, installing the swellable packer 30 includes slipping on the swellable packer 30 around the blank section 24 of the shoe assembly 22.

After the swellable packer 30 is pre-installed in the method according to one or more embodiments of the present disclosure, the gravel packing system 10 is deployed in the wellbore 12 such that the shoe assembly 22, the swellable packer 30, the base pipe 19, and the sand control screen 18 are disposed in an openhole, uncased section 15 of the wellbore 12. The method according to one or more embodiments of the present disclosure further includes swelling the swellable packer 30 until the swellable packer 30 contacts a wall of the wellbore 12 in the uncased section 15, forming a seal. The method according to one or more embodiments of the present disclosure further includes setting the gravel pack packer 32 against the casing 13 in the cased section of the wellbore 12 and starting a gravel packing operation using the gravel packing system 10. In one or more embodiments of the present disclosure, the swellable packer 30 starts swelling during the deployment of the gravel packing system 10 into the wellbore 12. In other embodiments of the present disclosure, the swellable packer 30 starts swelling during the gravel packing operation. The method according to one or more embodiments of the present disclosure further includes starting a production operation after the gravel packing operation is completed.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A gravel packing system deployed in a wellbore having cased and uncased sections, the gravel packing system comprising:

a shoe assembly comprising a washdown shoe at an end of the shoe assembly and a blank section uphole of the washdown shoe;

a base pipe having an upper base pipe joint and a lower base pipe joint coupled at a base pipe joint connection;

a screen disposed around the base pipe, wherein the lower base pipe joint is uphole of and adjacent to the blank section of the shoe assembly; and a swellable packer installed around the blank section of the shoe assembly, wherein the shoe assembly, the swellable packer, the base pipe, and the screen are disposed in the uncased section of the wellbore.

2. The gravel packing system of claim 1, further comprising: a gravel pack packer; and a formation isolation device disposed in the cased section of the wellbore.

3. The gravel packing system of claim 1, wherein the blank section of the shoe assembly provides a box end for a pin end of the lower base pipe joint.

4. The gravel packing system of claim 1, wherein the base pipe is perforated.

5. The gravel packing system of claim 1, wherein the swellable packer is configured to slip onto the blank section of the shoe assembly.

6. A method comprising:

installing a swellable packer in a gravel packing system, the gravel packing system comprising:

a shoe assembly comprising a washdown shoe at an end of the shoe assembly and a blank section above the washdown shoe;

a base pipe having an upper base pipe joint and a lower base pipe joint coupled at a base pipe joint connection; and a screen disposed around the base pipe, wherein the lower base pipe joint is above and adjacent to the blank section of the shoe assembly, and wherein the swellable packer is installed around the blank section of the shoe assembly;

deploying the gravel packing system in a wellbore such that the shoe assembly, the swellable packer, the base pipe, and the screen are disposed in an uncased section of the wellbore;

swelling the swellable packer until the swellable packer contacts a wall of the wellbore in the uncased section;

starting a gravel packing operation using the gravel packing system; and starting a production operation after the gravel packing operation is completed.

7. The method of claim 6, wherein the step of swelling the swellable packer starts during the deploying step.

8. The method of claim 6, wherein the step of swelling the swellable packer occurs during the gravel packing step.

9. The method of claim 6, wherein the gravel packing system further comprises: a gravel pack packer; and a formation isolation device disposed in a cased section of the wellbore, the method further comprising:

setting the gravel pack packer before the starting the gravel packing operation step.

10. The method of claim 6, wherein the blank section of the shoe assembly provides a box end for a pin end of the lower base pipe joint.

11. The method of claim 6, wherein the base pipe is perforated.

12. The method of claim 6, wherein the installing step comprises slipping on the swellable packer around the blank section of the shoe assembly.

* * * * *